United States Patent [19]

Agabekov

[11] 4,158,221

[45] Jun. 12, 1979

[54] LIGHT FIXTURE

[76] Inventor: Youri Agabekov, 54 bis quai Gustave Ador, Geneva, Switzerland, 1207

[21] Appl. No.: 780,052

[22] Filed: Mar. 22, 1977

[30] Foreign Application Priority Data

Mar. 22, 1976 [CH] Switzerland ..... 3514/76

[51] Int. Cl.[2] ..... H05B 33/02; F21S 1/02

[52] U.S. Cl. ..... 362/219; 362/249; 362/226

[58] Field of Search ..... 362/219, 227, 226, 382, 362/432, 457, 217, 249; 174/129, 117 R; 339/21 R, 22 R, 23, 52 R

[56] References Cited

U.S. PATENT DOCUMENTS

| | | | |
|---|---|---|---|
| 1,912,424 | 6/1933 | Batter | 339/21 R |
| 2,429,951 | 10/1947 | Weisberg | 339/52 R |
| 2,441,698 | 5/1948 | Gerspacher et al. | 339/23 |
| 3,029,303 | 4/1962 | Severino | 339/23 |
| 3,527,933 | 9/1970 | Thummel | 362/226 X |

*Primary Examiner*—William M. Shoop
*Assistant Examiner*—Peter S. Wong
*Attorney, Agent, or Firm*—Harness, Dickey & Pierce

[57] ABSTRACT

A fixture for a plurality of tubular electric lamps comprises an elongated insulating angle bar-frame having two flat mutually perpendicular flanges joined by a flat central web at 45° to the flanges. Flat conductors on the inner faces of the flanges carry alternately-disposed pairs of L-shaped brackets which support the lamps in axial alignment. The frame can be secured by self-adhesive bands on the outer faces of the flanges, or by screws passing through the central web.

7 Claims, 1 Drawing Figure

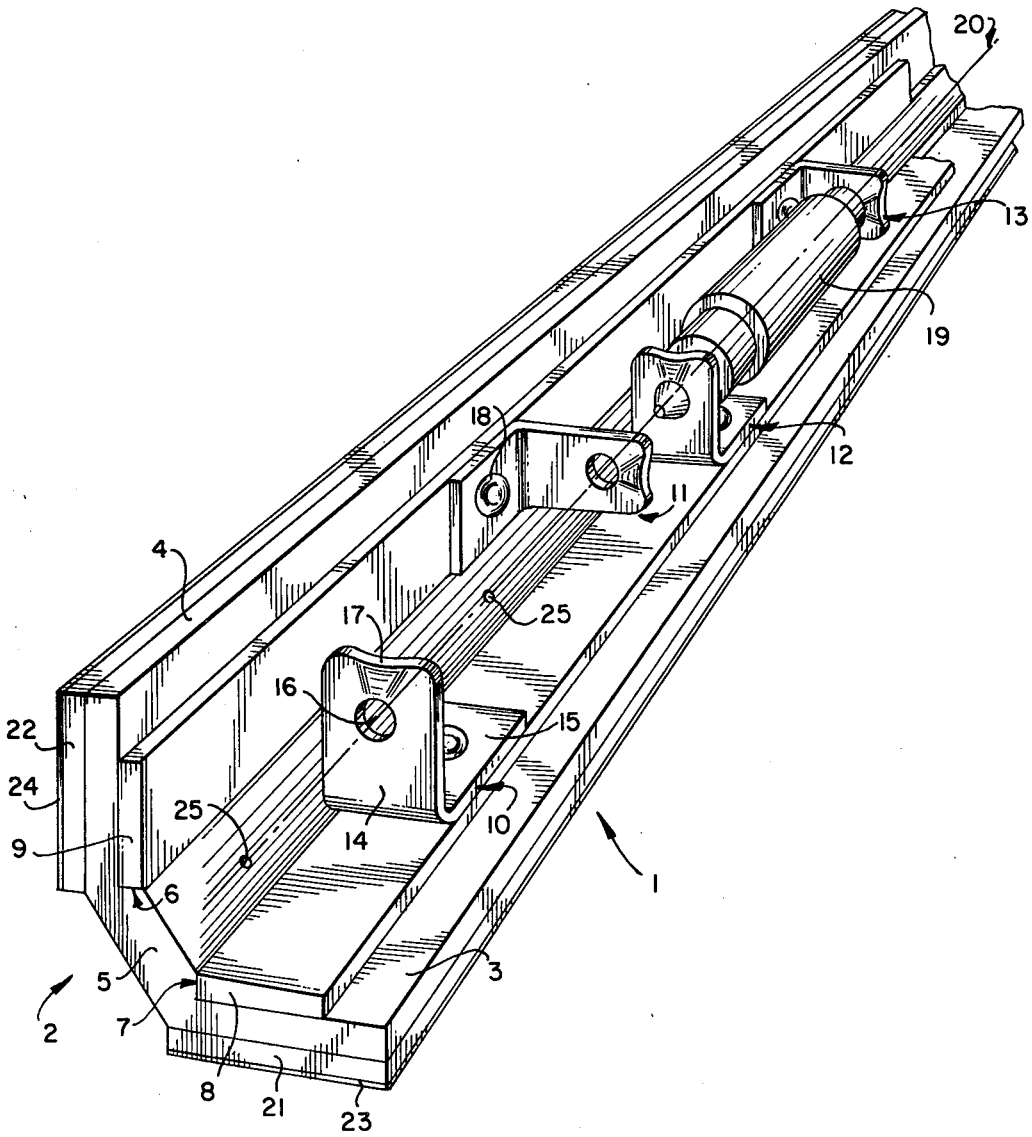
20
13
19
18
12
11
4
25
17
16
15
22
24
25
14
10
9
1
6
5
3
2
7
8
21
23

LIGHT FIXTURE

BACKGROUND OF THE INVENTION

The invention relates to fixtures for a plurality of elongated tubular electric lamps having contact caps at both ends; for convenience such lamps will hereinafter be referred to as tubular lamps, or simply as lamps.

Such fixtures have in the past been known and in the broad sense consist of a long support carrying a series of tubular lamps for illuminating display windows, bookshelves, the insides of large pieces of furniture, and so on.

Known fixtures of this type usually consist of a flat insulating support carrying two spaced-apart flat conductor bars disposed side-by-side. On their sides, the conductor bars have projecting parts which are bent to receive and carry the ends of tubular lamps placed along a common axis parallel to the support. The conductor bars are connected to a current supply and their bent projecting parts serve both to carry the lamps and supply current to them.

These known fixtures have numerous disadvantages. Manufacture of the conductor bars with projecting lamp-carrying parts is relatively complicated as several cutting templates are required to obtain different spacings between lamps in order to modify the intensity of illumination. For example, if one desires to space the adjacent tubular lamps along the rail by 10 cm, the cutting and folding of the projecting parts will be different than for a spacing of, say, 5 cm. Moreover, cutting of the metal bars involves a waste of material, the part situated between two projections being lost; this is all the more important as the spacing between adjacent lamps increases. Furthermore, at least two operations of folding by 90° are necessary after cutting, a first folding operation to bring the projecting part perpendicular to the conductor bar, and a second folding operation to bring the lamp-supporting projecting part perpendicular to the axis along which the lamps are mounted. After these three operations, it is still necessary to secure conductor bars on their support after verification that the distance between each pair of lamp holders corresponds to the length of the lamp. When the rail is installed, none of the parts under voltage, or the lamps themselves, are protected unless extra protective parts, such as a reflector, or a diffusing glass cover, are fitted. Also, when the rail is fitted in an angle in a piece of furniture, the lamps and lamp holders are close to walls of the piece of furniture; as a result, short-circuits may be caused by touching of a piece under voltage with the piece of furniture, and the piece of furniture may be undesirably heated by the lamp.

An object of the invention is to eliminate or palliate these drawbacks by providing a lamp fixture of simple construction and low cost, that can be easily fitted and can receive accessories (such as reflectors and diffusing glass covers) without a need for additional assembly parts, and in which the parts under voltage and the lamps are protected and cannot come into contact with elements on which the rail is fitted.

The invention accordingly provides, in a fixture for tubular lamps comprising two metal conducting bars mounted on an elongated support and lamp-holding conducting pieces projecting from the bars, the improvement wherein the support is an angle member having two flat flanges disposed perpendicular to one another and extending parallel to an axis of the angle member, said metal bars being carried by inner surfaces of said two flat flanges, said lamp-holding conducting pieces being L-shaped brackets fixed alternately in pairs and with selected spacings along one metal bar and the other, said brackets having upstanding parts protruding from and disposed transverse to the respective bars, and said upstanding parts of all the brackets having aligned portions which include means for holding lamps parallel to the axis of the angle support member.

In a preferred embodiment, the upstanding parts of the brackets each have means defining a socket opening for receiving an end cap of an end of a lamp and an indent for guiding said cap into the socket opening, the other part of each bracket being rivetted on one of said metal bars and the respective flange of the support. The two brackets of each pair are fixed on the two metal bars with a spacing corresponding to the length of the lamps, the spacing between adjacent brackets of different pairs being selected as a function of a desired lighting intensity.

The two perpendicular flanges of the angle support member may be connected by a flat central web forming an angle of 45° with the two flanges and of substantially the same width as each flange. Self-adhesive bands are advantageously disposed on the external faces of the flanges, whereas the central web has regularly spaced screw holes.

The fixture according to the invention may be installed at any desired location in a piece of furniture or along a plane surface. When the fixture is fitted on a plane surface, for example by means of the self-adhesive band of one of its flanges, or by screws extending through the central web, the self-adhesive band or bands of the other flange or flanges, as the case may be, can be used to mount a reflector, a thin sheet of diffusing glass or a safety barrier. When the fixture is placed in the angle formed by two perpendicular walls, the two self-adhesive bands will be used to secure the assembly to the two walls. The flanges provide both electrical and thermal insulation between the walls and the parts under voltage and the lamps. In addition, the axis of the lamps is substantially centered over each conductor bar. That is, the lamp axis lies approximately in both longitudinal planes projected perpendicularly from the center lines of the bars. Thus the conductor bars also tend to intercept and reflect light and heat from the lamps.

Manufacture of the assembly is very simple, as the support, the self-adhesive bands, the metal bars and brackets are all commercially available. It thus suffices to assemble by rivetting. As the brackets and metal bars are rivetted on the support in a single operation, the distance between two brackets of a pair for holding one tubular lamp, and the distance between the adjacent brackets of two pairs, can be chosen at will.

The single FIGURE of the accompanying drawings shows, by way of example, and in perspective, a length of a preferred embodiment of a fixture for tubular lamps according to the invention.

The assembly 1 shown in the drawing comprises a support 2 of insulating material, for example synthetic plastic material, in the form of an elongated angle member having two flat flanges 3 and 4 perpendicular to one another and connected by a flat central web 5 of substantially the same width as the flanges 3 and 4 and inclined at 45° to them. The central web 5 has edges 6 and 7 perpendicular to the inner surfaces of the respective flanges 3 and 4, these edges 6 and 7 serving as lateral supports for flat metal conducting bars 8 and 9.

Along the bars 8 and 9 are fixed pairs of L-shaped brackets 10, 11; 12, 13; and so on, each bracket having two perpendicular parts 14 and 15 (see bracket 10). The upstanding part 14 has an opening 16 defining a socket for receiving and holding one of the end-caps of a tubular lamp, and an indent 17 adjacent its outer edge for facilitating insertion of the lamp cap in the opening 16. The brackets 10, 11, 12, 13, . . . are fixed on the bars 8, 9 by means of a rivet 18 passing through each bracket 10, 11, 12, 13, . . . , the respective bar 8, 9 and the respective flange 3, 4 of the support 2. The brackets 10, 11; 12, 13; . . . are alternately mounted on the bars 8, 9 in pairs, each pair being able to receive and hold a tubular lamp 19 (as shown for the pair 12, 13). The length of the upstanding parts of the brackets is chosen so that they have aligned portions whereby the openings 16 are all aligned along an axis 20 parallel to the axis of support 2. As the brackets are secured by rivets, the distances between the upstanding parts of each pair of brackets (10, 11; 12, 13; . . . ), as well as the spacing of the upstanding parts of the adjacent brackets of different pairs (e.g. 11 and 12), can be selected and adapted as need be.

The assembly can be assembled without difficulty, the metal bars 8, 9 simply being pressed against their bearing surfaces (edges 6, 7), and the brackets rivetted successively with predetermined spacings.

The external surfaces of the flanges 3, 4 of support 2 are fitted with self-adhesive bands 21, 22 having removable protective papers 23, 24. The central web 5 of the support 2 has regularly spaced securing holes or bores 25.

The described embodiment may, of course, be modified. For example, the central part 5 disposed at 45° to the two edge parts 3, 4 of the support 2 could be dispensed with, the support thus being an L-shaped section bar. Likewise, the shape of the brackets may be modified, and they can be secured to the support by other means, for example by spot welding. Although the conducting parts, i.e. the bands 8, 9 and the brackets 10, 11, 12, 13, . . . are preferably of copper or brass, other conducting metals may be used. As shown in the drawing, the angular central web not only provides spacing between each bracket and the other conductor bar, but also blocks and prevents any possible turning of the brackets around the axis of the rivets if they should be forced or work loose over a period of time. This furnishes positive protection against accidental short circuits.

What is claimed is:

1. A fixture for a plurality of tubular electric lamps, said fixture comprising an elongated frame of generally L-shaped cross section formed of insulating material and comprising a pair of longitudinally extending flanges substantially at right angles to each other, a pair of electrically conductive flat metal bars, one such bar extending longitudinally on and lying flat against the inner wall of each flange of the frame, a plurality of pairs of lamp supporting brackets carried by said bars in positions longitudinally spaced therealong, each pair of brackets comprising one bracket attached to one of said bars and another bracket attached to the other of said bars, each of said brackets having a lamp supporting arm cooperating with the lamp supporting arm of the other bracket of the pair, each lamp supporting arm projecting from the bar to which it is attached to a position beside but spaced from the other bar, a lamp supporting portion carried by each of said arms, the lamp supporting portions of each pair of brackets being adapted to support a tubular lamp in a position substantially parallel to and overlying but spaced from both bars with the axis of the lamp lying substantially on the line of juncture of two projected longitudinal planes, one of which planes also includes the longitudinal centerline of one of the bars and the other of which planes also includes the longitudinal centerline of the other bar.

2. A fixture as defined in claim 1 wherein said planes are perpendicular to the flat faces of the bars.

3. A fixture as defined in claim 1 wherein said planes are perpendicular to the flat faces of the bars and the width of the bars is equal to at least a substantial percentage of the diameter of the lamps whereby the bars underlie the lamps in positions to intercept and reflect light and heat from the lamps.

4. In a fixture as defined in claim 1, a spacing wall lying between and serving to connect the flanges of the frame and having portions lying at an angle to each of said flanges of the frame and located beside each lamp supporting bracket in positions to block movement of each bracket toward the bar from which it is spaced.

5. A fixture as defined in claim 4 in which the lamp supporting brackets are riveted to the bars and wherein said portions of the spacing wall which block movement of the brackets prevent unwanted rotation of said brackets around the rivets.

6. A fixture as defined in claim 5 wherein said lamp supporting brackets are of L-shape, each bracket having a base flange lying flat on the bar to which it is attached, and a rivet extending through each base flange and through the bar and through the flange of the frame, to secure the brackets and bars to the frame.

7. A fixture as defined in claim 4 wherein the lamp supporting brackets are formed of L-shaped sections of strap metal, each bracket having a base flange lying flat on and secured to one of the bars and having a substantially flat flange defining the lamp supporting arm and projecting perpendicularly from the base flange.

* * * * *